United States Patent [19]

Mabuchi

[11] 4,021,150

[45] May 3, 1977

[54] BATTERY POWERED PUMP

[75] Inventor: Kenichi Mabuchi, Tokyo, Japan

[73] Assignee: Mabuchi Motor Co. Ltd., Tokyo, Japan

[22] Filed: June 30, 1975

[21] Appl. No.: 591,450

[30] Foreign Application Priority Data

July 2, 1974 Japan ..... 49-76072

[52] U.S. Cl. ..... 417/411; 415/169 R

[51] Int. Cl.[2] ..... F04B 35/04

[58] Field of Search ..... 415/169; 417/411, 234

[56] References Cited

UNITED STATES PATENTS

| | | | |
|---|---|---|---|
| 823,027 | 6/1904 | Pitman | 415/169 |
| 1,108,053 | 8/1914 | Wiwi et al. | 417/411 |
| 2,595,406 | 5/1952 | Popovich | 417/411 |
| 2,909,316 | 10/1959 | Proltaczka | 417/411 |
| 2,919,120 | 12/1959 | Baxter | 417/411 |
| 2,961,129 | 11/1960 | Bullock | 417/411 |
| 3,195,148 | 7/1965 | Merkel, Jr. | 417/411 |
| 3,647,323 | 3/1972 | Thomas | 417/411 |
| 3,697,198 | 10/1972 | Holder, Jr. | 417/411 |
| 3,719,429 | 3/1973 | Rule | 417/411 |
| 3,885,127 | 5/1975 | Walter et al. | 417/411 |

*Primary Examiner*—Carlton R. Croyle
*Assistant Examiner*—L. J. Casaregola

[57] ABSTRACT

Leakage of fluid is prevented by a negative pressure created in a motor-shaft bearing section by providing means for forcing fluid in the pumping chamber to flow in one direction.

17 Claims, 9 Drawing Figures

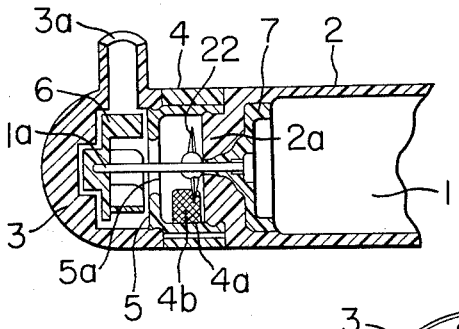
FIG. 5
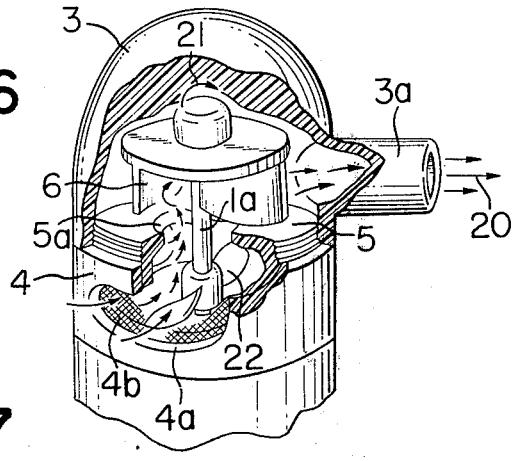
FIG. 6
FIG. 7
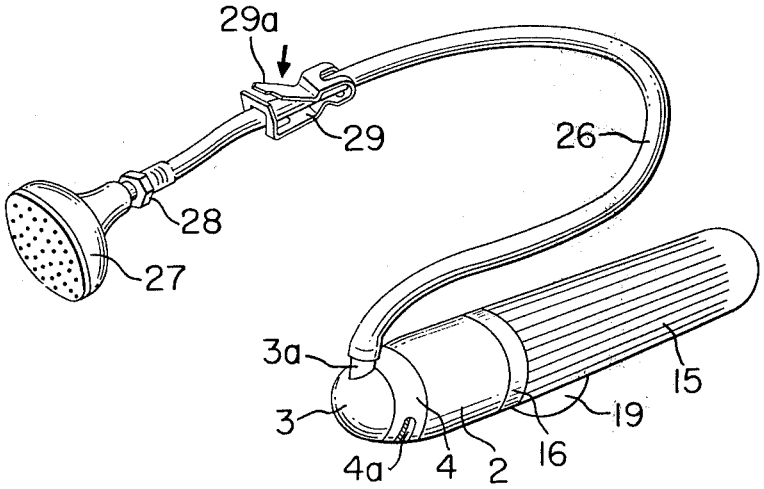

BATTERY POWERED PUMP

BACKGROUND OF THE INVENTION

1. Field of the invention

The present invention relates to a battery powered pump, and more particularly to a battery powered pump in which means are provided for forcing fluid in the pumping chamber to flow in one direction and creating a negative pressure on the motorshaft bearing section.

2. Description of the prior art

The development in recent years of nickel-cadmium batteries with extremely low internal resistance and capable of delivering discharge current on the order of several amperes and also of quick charging in several minutes or not much longer than ten minutes has substantially expanded the field of battery powered devices. To take advantage of the situation, small and low-cost battery powered pumps are desirable for use with such devices as simplified water fountain equipment, hand or wall showers, bottle washers, water pistols, etc.

However, to manufacture this type of pump, it is necessary to make the battery chamber and the motor chamber watertight by packing the bearing of the motor shaft which drives vanes in the pump chamber. This packing necessarily means a considerable load on the motor and consumption of the battery power high enough to spoil the economy of a commercial article. Also, where vanes pump out fluid, the closer the vanes are to the motor bearing, the smaller will be the vane driving torque and the battery consumption. However, the flow of fluid is partly directed toward the motor shaft bearing and, therefore, a tighter packing around the bearing will be required with a resultant higher battery consumption.

SUMMARY OF THE INVENTION

An object of the present invention is to provide a battery powered pump having a fluid flow directing or control means to force fluid admitted through an inlet port to flow away from the motor-shaft bearing in the direction along the motor shaft, thereby preventing, by utilizing the effect of negative pressure created by the fluid flow so directed, the fluid from leaking through the motor shaft bearing even when the bearing is provided with a light packing, with the resultant reduction of the battery consumption.

Another object of this invention is to provide a battery powered pump in which the pump chamber may be disassembled and cleaned in simple steps.

A further object of this invention is to provide a battery powered pump in which the outlet port may be turned to any direction as desired.

BRIEF DESCRIPTION OF THE DRAWINGS

FIGS. 5 and 6 are a longitudinal section and a partly cut-away perspective view, respectively, of a pump chamber of a pump as another embodiment of this invention.

FIG. 7 is a general perspective view of a pump of this invention as applied to a washer;

DETAILED DESCRIPTION OF THE EMBODIMENT

Figure 1:
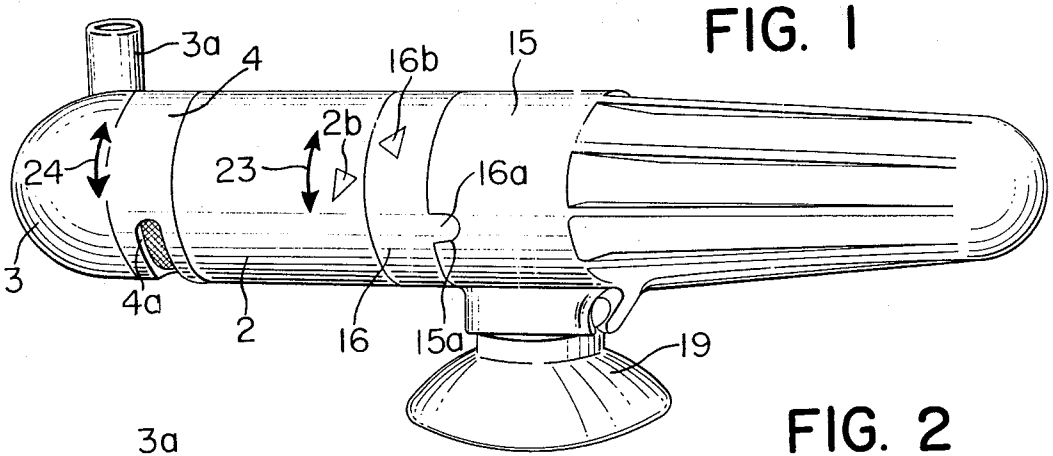
FIG. 1 is a general perspective view of a battery powered pump as an embodiment of the present invention.

As shown in FIG. 1, a motor housing 2 containing a motor 1 engages with an annular ring member 4 having an inlet or admission port 4*a* and a pump chamber housing 3 having an outlet of discharge port 3*a*. The ring member 4 and the pump chamber housing 3 form an integral body which can rotate as shown by arrow heads 24 relative to the motor housing 2 so that the discharge port 3*a* may be turned to any direction as desired.

The opposite face of the motor housing 2 engages with a middle casing 16 and a battery housing 15 which contains batteries, and the middle casing 16 and the battery housing 15 are coupled to form an integral body by means of an indentation 15*a* and a projection 16*a* and may rotate relative to the motor housing 2. It is so constructed that, when rotational movement shown by arrowheads 23 brings switch marks 2*b* and 16*b* to a position where they are aligned, a power circuit for the motor 1 is closed. At a position approximately at the center of gravity of the entire pump structure is provided a suction cup 19 with which the pump may be fitted to another body.

Figure 2:
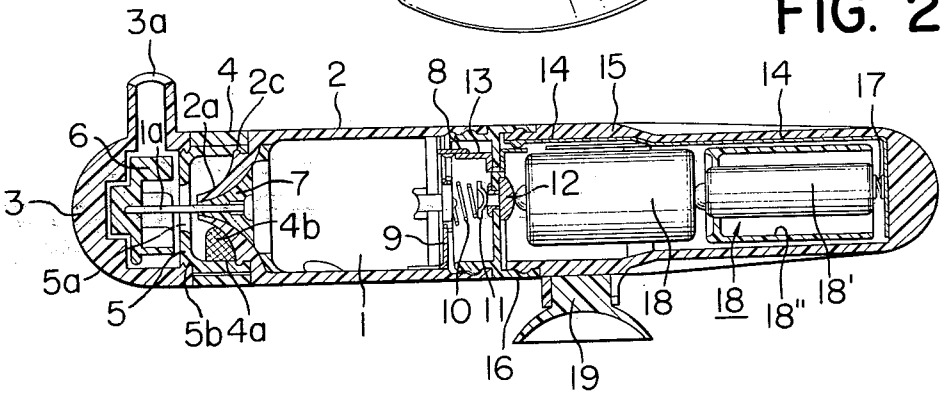
FIG. 2 is a general sectional view of the battery powered pump.

As shown by the sectional drawing in FIG. 2, the motor 1 is housed in the motor housing 2, and batteries 18, 18 in the battery housing 15. The positive electrode of one battery 18 is in electrical contact with a positive contact 12 extending through a partition wall of the middle casing 16, and the negative electrode of the other battery 18 is in electrical contact, via a spring 17, with one end of a negative lead strip 14, while the other end of the lead strip 14 is connected to a negative contact strip 13 fixed to the partition wall of the middle casing 16.

The positive contact 12 extends through the partition wall of the middle casing 16 and contacts a cap 11 attached to a spring 10 fastened to a positive terminal 9 of the motor 1. The negative terminal of the motor 1 is connected to a negative terminal strip 8, and as explained in relation to FIG. 1, when the relative rotational movement of the battery housing 15 and the motor housing 2 brings the terminal strip 8 into contact with the terminal strip 13 as shown in FIG. 2, the motor 1 is energized by the batteries 18, 18 to start running.

The battery housing 15 in the drawing is designed to have inside dimensions for accommodating conventional UM-2 dry cells, and when smaller quick charging nickel-cadmium batteries 18' are to be used, the battery housing 15 will be provided with an adapter 18'' for each such battery 18' to make it dimensionally equivalent to a UM-2 cell.

Figure 4:
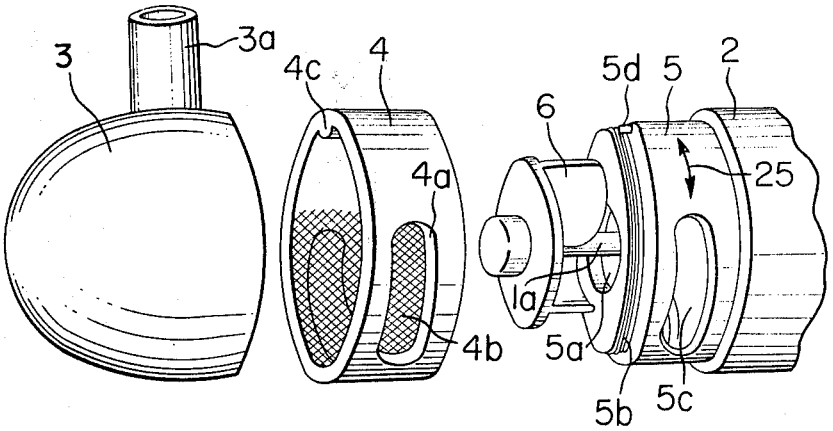
FIG. 4 is an exploded view of the pump chamber.

The left end of the motor housing 2 in the drawing has a motor-shaft bearing section 2*a* shaped like a cone having a concave outer surface and an apex facing the housing 3, and a motor shaft 1*a* protected by a simple seal ring 7 sealingly extends through the bearing section 2*a* into the pump chamber housing 3. As shown in FIG. 4, the left end of the motor housing 2 is also fitted to an annular inner case 5 having an end wall formed with a central opening or inner port 5*a*. This inner case 5 rotatably fits on an engagement ridge 2*c* for engaging with the left end of the motor housing 2 so that it can make rotational movement relative to the motor housing 2 as shown by the arrowheads in FIG. 4. As shown also in FIG. 4, the ring member 4 having the admission port 4*a* fits onto the inner case 5 in a manner that a ridge 4*c* engages with a groove 5*d* to serve as a stopper for preventing rotational displacement between the ring member 4 and the inner case 5. This also accomplishes correctly coincided positioning of the admission port 4*a* of the ring section 4 and the inner port 5*c* of the inner case 5. A filter screen 4*b* is provided inside the ring member 4 covering the admission port 4*a* of the ring member 4. The ring member 4 is removable from the inner case 5 for easy cleaning of the filter net 4*b*.

Figure 3:
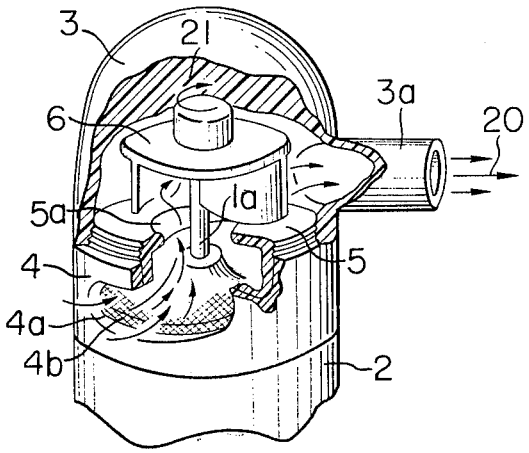
FIG. 3 is a perspective view of a pump chamber of the pump partly cut away.

As shown in FIGS. 1, 2, and 3, the inner case 5 has the port 5*a* in the center to control flow of fluid. The motor shaft 1*a* coaxially extends through this port 5*a*, and a pump impeller of vanes 6 are attached to the end of the motor shaft 1*a*. The inner case 5 also has a threaded portion 5*b* on the shoulder, and the pump chamber housing 3 is screwed onto this threaded portion 5*b* to accomplish integral coupling of the pump chamber housing 3, the ring member 4, and the inner case 5, so that the integrated body may be rotated relative to the motor housing 2 in the direction shown by the arrowheads 24 in FIG. 1, for the purpose of changing the direction of the discharge port 3*a*, as explained before relative to FIG. 1.

When the motor 1, which is disposed as above, is energized for rotation, the pump vanes 6 rotate in a pump chamber defined by the inner case 5 and the pump chamber housing 3. With the pump entirely submerged in fluid, the fluid flows into the pump through the admission port 4*a*, flows through the port 5*c*, the port 5*a*, and the pump vanes 6 in this order, and is discharged from the discharge port 3*a*.

With the fluid flowing as described above, the concave external surface of the motor-shaft bearing section 2*a* serves to urge the fluid to flow away from the motor-bearing section 2*a* in the direction of the motor shaft 1*a* to the port 5*a*, and the port 5*a* serves to converge the flowing fluid into a steamline flow to be fed to the pump vanes 6. In other words, the above concave external surface constitutes a flow direction control means as a characteristic feature of the present invention.

Because of this arrangement, the motor-shaft bearing section 2*a* is under a negative fluid pressure while the fluid continues to flow, and fluid is prevented from flowing into the motor 1 through the motor-shaft bearing section 2*a*. Therefore, the seal ring 7 used in this invention can be a light seal meeting the simple requirement of preventing fluid leaking when the motor 1 is not running.

While working on this invention, the inventor at first built a pump in which the positions of the discharge port 3*a* and the admission port 4*a* were reversed, with the result that fluid leaked into the motor 1 so freely that the pump was quite unusable for any practical application. Of course, it is not very difficult to substantially improve the seal ring 7 for effectively preventing fluid from leaking into the motor 1, but a better seal ring 7 immediately means more load on the motor shaft 1*a* and a larger motor current required for pumping fluid to obtain a given flow rate and, consequently, higher power consumption of the battery 18. To deal with this situation, this invention makes a simple seal practically usable, taking advantage of the effect of negative pressure created by the flow direction control means.

In experiments made by the inventor, a pump embodied as shown in FIG. 1, which used two UM-2 dry cells connected in series and water as a fluid to pump, pumped at a rate of 2.67 liters per minute with current of 1.6A. To experiment using the pump with a water fountain, the discharge port 3*a* was connected to a fountain nozzle, and the result was that the nozzle spouted water as high as 4 meters with a motor current of 0.8 to 0.9A for about 30 minutes. Where UM-3 nickel-cadmium batteries 18′ are used, they are sufficient to operate the pump for about 20 minutes. In this case, these batteries can be recharged in several minutes to 10 minutes even after discharging until the battery voltage drops to nearly zero, which is very advantageous economically.

FIGS. 5 and 6 show another embodiment of the present invention. In this case a propeller 22 is installed at a location close to the motor-shaft bearing section 2*a* and, as shown in FIG. 6, the fluid is pushed by this propeller 22 toward the pump vanes 6, thereby creating the effect of negative pressure to prevent the leakage of fluid in a manner similar to that of the case illustrated in FIGS. 2 and 3.

As described above, this invention provides a small and low-cost pump, and the provision of the flow direction control means makes the pump capable of preventing leakage of fluid without increasing the motor current from the battery 18 required to run the motor 1. The filter screen 4*b* may also be cleaned simply by detaching the pump chamber housing 3 and the ring member 4 from the motor housing 2.

A pump of this invention does not necessarily have to be submerged in fluid, but it can suck up fluid through a pipe connected to the admission port 4*a*.

Figure 8:
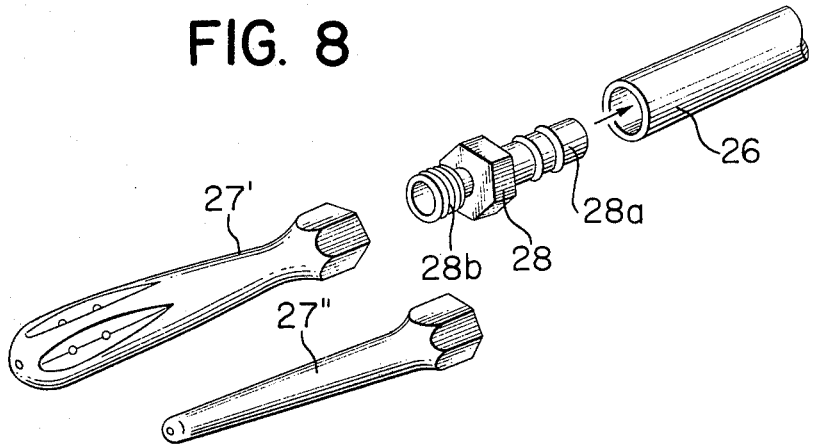
FIG. 8 is an exploded perspective view showing the combinations of hose and jet discharge attachments when a pump of this invention is used for a washer.

FIG. 7 and FIG. 8 show the above battery powered pump as used for a washer.

As shown in the drawing, one end of hose 26 is attached to the discharge port 3*a* of the above battery powered pump, a shower nozzle or fluid jet discharge attachment 27 is fitted to the other end of the hose 26 via a coupling means 28. This coupling 28, as shown in FIG. 8, comprises a hose coupling member 28*a* for fitting into said other end of the hose 26 and an attachment mount 28*b* to which various types of nozzles can be interchangeably mounted. 29 is a flow control means or hose clamp. As is apparent in the drawing, the hose 26 extends through this control means 29, and the fluid flow to the above attachment 27 can be shut off by pressing a control plate 29*a* in the direction shown by an arrowhead. It is needless to say that the fluid flow can also be adjusted by adjusting the pressure applied to the control plate 29*a*.

To use the washer so arranged as above, the entire battery powered pump is submerged in fluid and switches on and the control plate 29*a* of the discharge control means 29 is released. Fluid will be discharged from the fluid jet discharge attachment 27 and the fluid discharge rate can be readily controlled by adjusting the pressure applied to the control plate 29*a* of the flow control means 29.

FIG. 8 is an exploded perspective showing how to combine the hose 26 with an attachment 27′ or 27″ embodying this invention.

FIG. 8 illustrates attachments 27′ and 27″ to be mounted on the attachment mount 28*b* of the coupling 28. Different from the attachment 27 in FIG. 7 which is a shower nozzle, the attachment 27′ had jet spouting holes at the tip and the side surfaces and the attachment 27″ or fountain nozzle has a jet spouting hole only at the tip. The inner wall, not illustrated, of the mounting end of each of the attachments 27, 27′ and 27″, is formed to screwably fit on the screw threads on the attachment mount 28*b* of the coupling means 28. The attachment 27′ with jet spouting holes at the tip and the side surfaces as shown in FIG. 8 is effective for cleaning washable articles having hollow inner walls such as bottles.

Figure 9:
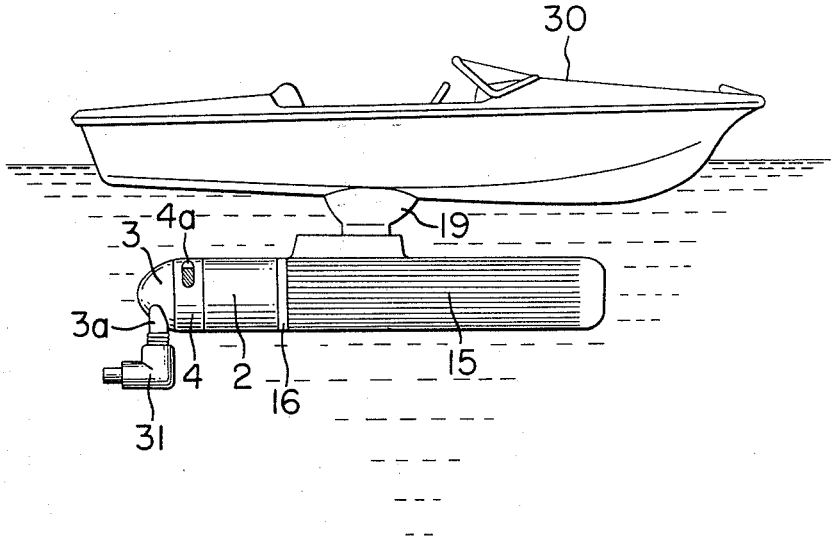
FIG. 9 is a side view of a pump of this invention as an underwater attachment to an aquatic toy-model.

FIG. 9 is a side view of an aquatic toy-model using the above pump, which is one of the applications of this invention taking advantage of a feature of the pump that it can be operated submerged in fluid.

As shown in the drawing, the battery powered pump of this invention is attached to a model boat 30 by using the suction cup 19 mounted on the pump. A jet discharge nozzle 31 is fitted to the discharge port 3*a* and the spout of the jet discharge nozzle 31 is aimed backward with respect to the model boat 30. In the aquatic toy-model so arranged as above, when the battery powered pump is energized by the relative rotational movement as indicated by the arrowhead 23 in FIG. 1, fluid will be sucked in through the admission port 4*a* and, via the discharge port 3*a*, will be discharged from the jet nozzle 31. As the jet nozzle 31 is aimed opposite to the direction of movement of the model boat 30 as described above, the model boat 30 will obtain propelling force from the discharge of fluid from the jet nozzle 31.

Also, as explained above, the discharge port 3*a* in the pump chamber housing 3 can be rotated, together with the ring member 4, relative to the motor housing 2, and this allows the positional relationship between the jet nozzle 31 and the model boat 30 to also be varied. The direction of movement of the model boat 30 can be thereby selected as desired by making the above relative rotation as indicated by the arrowheads 24 in FIG. 1.

The above described application of this invention to an aquatic toy-model makes it possible to provide a model boat, having no on-board power equipment, with propelling force simply.

What is claimed is:

1. A battery powered pump comprising a battery chamber defined by a battery housing for one or more batteries, a motor chamber defined by a watertight and cylinder-shaped motor housing with a motor inside, a pumping chamber having admission and discharge ports, said pumping chamber being connected to the adjoining chamber via a motor-shaft bearing section, a motor shaft extending into said pumping chamber, pump vanes fixed on said motor shaft for sucking in fluid through said admission port and discharging the fluid from said discharge port; said admission port being located, relative to the location of said pump vanes, closer to said motor-shaft bearing section, a flow direction forcing device for forcing the flow of fluid in said pumping chamber in a direction from said motor shaft to said pumping vanes, thereby creating a negative pressure around said motor-shaft bearing section, a switching means which opens and closes, through a relative rotational movement of said motor housing against said battery housing; and an electric circuit for powering the motor in said motor housing, said battery housing and said motor housing being coupled together on a common axis to be rotational against each other.

2. A battery powered pump set forth in claim 1, wherein said pumping chamber housing further comprises a ring member whereby said pumping chamber housing and said ring member are detachably coupled and rotational against each other on a common axial line and this relative rotation makes it possible to set the opening of said discharge port of said pumping chamber housing in a direction as selected.

3. A battery powered pump set forth in claim 2, wherein said ring member has an admission port provided with a filter net and is detachably fitted to said above motor housing.

4. A battery powered pump set forth in claim 3, wherein an inner case having a circulation port is provided and is positioned such that the motor shaft extends through said circulation port whereby the fluid flows through said circulation port to become a converged stream and wherein an inner admission port in said inner case positionally coincides with the admission port in said ring member.

5. A battery powered pump set forth in claim 4 wherein said flow direction forcing device is formed by said motor-shaft bearing section at the end portion of said motor housing to the side of engagement with said ring member and also by a cone-shaped curved external surface formed on said motor-shaft bearing section.

6. A battery powered pump set forth in claim 5, wherein said cone-shaped curved external surface is concave.

7. A battery powered pump set forth in claim 5, wherein the top of said cone-shaped curved external surface is directed to said circulation port of said inner case.

8. A battery powered pump set forth in claim 2, wherein said flow direction forcing device is formed by said motor-shaft bearing section at the end portion of said motor housing to the side of engagement with said ring member and also by a propeller located close to said motor-shaft bearing section.

9. A battery powered pump set forth in claim 4, wherein said propeller rotates driven by the rotation of said motorshaft and directs the flow of fluid toward the circulation port of said inner case.

10. A battery powered pump set forth in claim 1, wherein a middle casing is provided to form an airtight partition between said battery chamber and said motor chamber and said switching means is provided to the side of said motor chamber.

11. A battery powered pump set forth in claim 1, wherein said battery chamber and said motor chamber are of watertight construction.

12. A battery powered pump set forth in claim 1, wherein a sucking disk is provided at a position approximately above the center of gravity of said pump.

13. A battery powered pump set forth in claim 1, wherein said discharge port is further provided with an interchangeable attachment.

14. A battery powered pump set forth in claim 13, wherein said attachment is a shower attachment.

15. A battery powered pump set forth in claim 13, wherein said attachment is a hollow rod having fluid jet discharge holes on its tip and side surface.

16. A battery powered pump set forth in claim 13, wherein said attachment is a hollow rod having a fluid jet discharge hole on its tip.

17. A battery powered pump set forth in claim 13, wherein a fluid discharge control means is provided between said attachment and said discharge port.

* * * * *